United States Patent [19]

Ataka

[11] Patent Number: 4,905,342

[45] Date of Patent: Mar. 6, 1990

[54] PORTABLE VACUUM CLEANER

[75] Inventor: Yasukazu Ataka, Ibaragi, Japan

[73] Assignee: Sharp Kabushiki Kaisha, Osaka, Japan

[21] Appl. No.: 320,235

[22] Filed: Mar. 7, 1989

Related U.S. Application Data

[60] Division of Ser. No. 80,976, Aug. 3, 1987, which is a division of Ser. No. 18,854, Feb. 24, 1987, Pat. No. 4,704,765, which is a continuation of Ser. No. 703,898, Feb. 21, 1985, abandoned.

[30] Foreign Application Priority Data

| | | | |
|---|---|---|---|
| Jun. 11, 1984 | [JP] | Japan | 59-87247[U] |
| Jun. 14, 1984 | [JP] | Japan | 59-89905[U] |
| Jun. 14, 1984 | [JP] | Japan | 59-89909[U] |
| Jun. 15, 1984 | [JP] | Japan | 59-89647[U] |
| Jun. 22, 1984 | [JP] | Japan | 59-94341[U] |
| Jul. 9, 1984 | [JP] | Japan | 59-104258 |

[51] Int. Cl.[4] ..... A47L 5/24

[52] U.S. Cl. ..... 15/327 E; 15/344; 15/347

[58] Field of Search ..... 15/344, 393, 347, 327 E, 15/354, 349

[56] References Cited

U.S. PATENT DOCUMENTS

| | | | |
|---|---|---|---|
| 3,193,992 | 7/1965 | Findley et al. | 15/344 X |
| 3,387,319 | 6/1968 | Ferraris et al. | 15/327 E |
| 3,460,188 | 8/1969 | Boyd | 15/349 X |
| 3,477,087 | 11/1969 | Robinson | 15/344 |
| 3,599,273 | 8/1971 | Shirayanagi | 15/344 X |
| 4,633,543 | 1/1987 | Sovis et al. | 15/344 |

FOREIGN PATENT DOCUMENTS

| | | | |
|---|---|---|---|
| 810445 | 3/1959 | United Kingdom | 15/327 E |

*Primary Examiner*—Chris K. Moore

*Attorney, Agent, or Firm*—Flehr, Hohbach, Test, Albritton & Herbert

[57] ABSTRACT

A portable vacuum cleaner contains within its housing a dust collecting part in front of a fan. A suction inlet is at the front end and the opening surface defined by it is nearly horizontal and either coplanar with or protruding below the bottom surface of the housing so that the accumulated dust will not fall out of the suction inlet when the fan is stopped.

4 Claims, 8 Drawing Sheets

PORTABLE VACUUM CLEANER

This is a division of Ser. No. 080,976, filed 8/3/87, which is a division of Ser. No. 018,854, filed 2/24/87, now U.S. Pat. No. 4,704,765, which is a continuation of Ser. No. 703,898, filed 2/21/85, now abandoned.

BACKGROUND OF THE INVENTION

This invention relates to a lightweight vacuum cleaner and in particular to a portable vacuum cleaner which is intended to be hand-carried as it sucks in dust through an inlet provided at its front end. Such lightweight vacuum cleaners will be referred to herein simply as portable vacuum cleaners, cordless or otherwise.

A portable vacuum cleaner according to a conventional design, as shown in FIG. 18, typically has a suction inlet 2 at the front edge of its housing 1 in such a way that its opening surface makes a rather large angle (Θ in FIG. 18) from the horizontal direction. When operating it, the user holds it by a handle 3 at the back and lifts its hind section as shown in FIG. 19, or causes it to stand on its front edge.

Since a vacuum cleaner of this type typically contains a dust collecting means such as a filter bag in front near the suction inlet 2 and an electric fan behind it, there is no problem as long as the fan is operating; but if the fan is stopped while the housing 1 is in the standing position, either for resting or for carrying the cleaner from one place to another, the dirt which has been accumulated inside the dust collecting means can easily fall out of the cleaner through the suction inlet 2. A method of preventing this is to provide a check valve made of a rubber sheet between the suction inlet 2 and the dust collecting means; but since this valve is operated by the motion of air caused by the electric fan, it is not effective against relatively heavy, small dust such as sand particles although large, light dust can be prevented from flowing backwards from the dust collecting means to the inlet 2.

SUMMARY OF THE INVENTION

It is therefore an object of this invention to eliminate the aforementioned drawbacks of the conventional portable vacuum cleaners by providing a lightweight vacuum cleaner which can be used with its housing held nearly horizontally and without causing the dust accumulated inside the dust collecting means to fall out of the suction inlet.

It is another object of the present invention to provide a portable vacuum cleaner which can perform a cleaning operation efficiently in a nearly horizontal position and from which collected dust can be removed easily.

It is a further object of the present invention to provide a lightweight portable vacuum cleaner which includes a storage section in the back of the housing where the cleaner interior is relatively less crowded so that suction accessories can be kept inside the cleaner housing.

The above and other objects of the invention will become apparent to those skilled in the art from an analysis of the following description of specific embodiments of the invention.

A portable vacuum cleaner according to one embodiment of the present invention has a suction inlet at its front edge, contains without its housing a dust collecting means and an electric fan in this order from the front to the back, and is unique in that the aforementioned suction inlet faces down and its opening surface is not only nearly horizontal but also coplanar with or protruding below the bottom surface of the housing. An additional characteristic of this embodiment is that the aforementioned suction inlet is provided with a removable accessory which can be stored, when not in use, in a storage section in the back of the housing, a door to this storage section being provided on the back surface of the housing.

According to another embodiment, a container section is provided in front of the fan and opening in the frontal direction. A detachable front cover including the suction inlet is provided to close the frontal opening of this container section. A bag filter is detachably attached to this opening so that when the cover is closed, the bag filter will fit inside the container section.

DETAILED DESCRIPTION OF THE INVENTION

Figure 1:
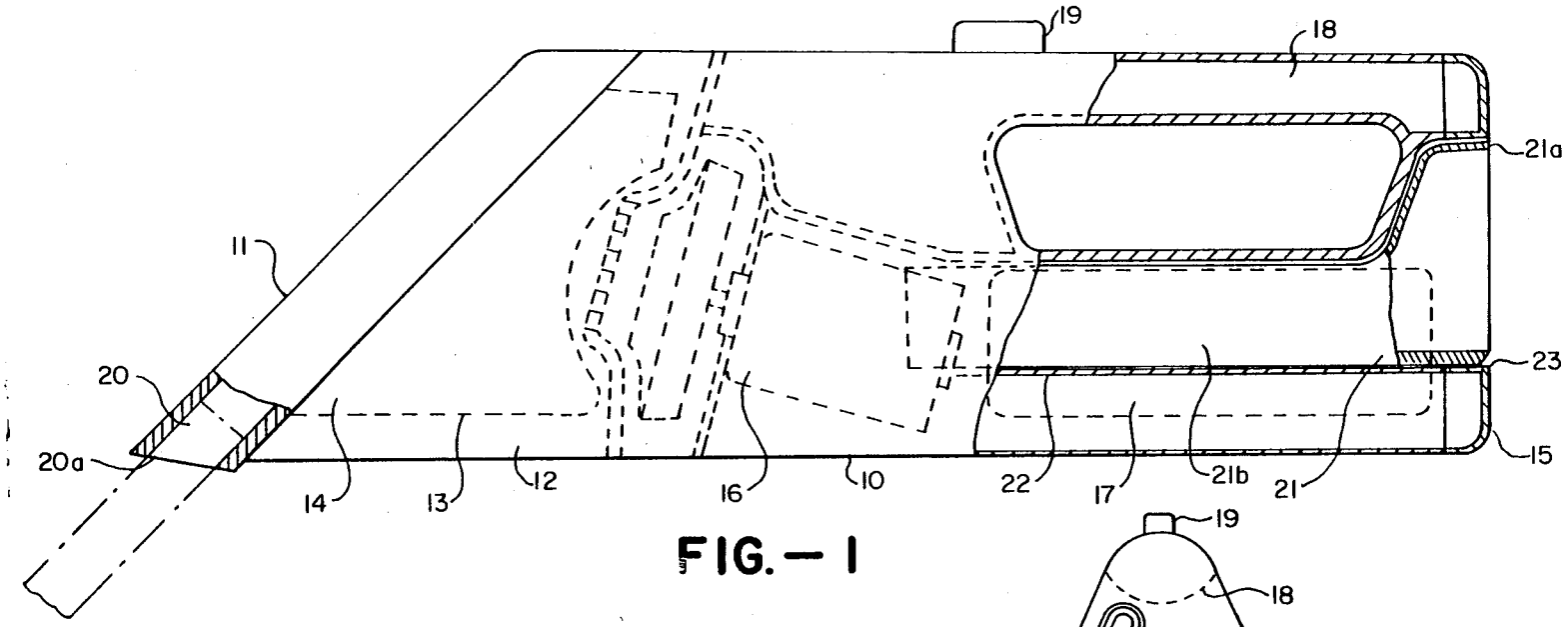
FIG. 1 is a partially sectional side view of a portable vacuum cleaner according to an embodiment of the present invention.
Figure 3:
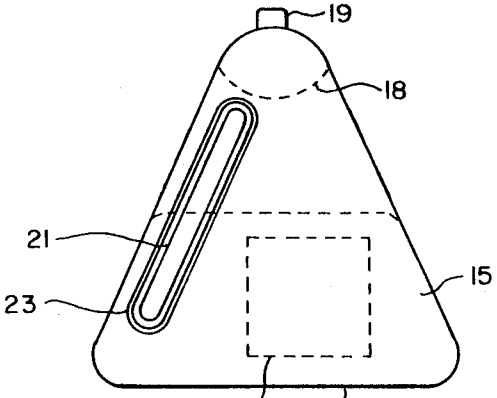
FIG. 3 is a back view of the cleaner of FIG. 1.
Figure 2:
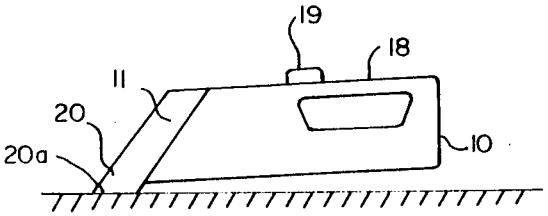
FIG. 2 shows how the cleaner of FIG. 1 is used.

There is shown in FIGS. 1, 2 and 3 a first embodiment of the present invention wherein a vacuum cleaner housing 10 includes a container section 12 which opens to the front and a detachable front cover 11 for closing this front opening of the container section 12. A filter 13, the interior of which defines a dust collecting means 14, is detachably attached to the inner surface of the front cover 11 so as to be contained inside the container section 12. A suction inlet 20 facing down is formed at the bottom of the front cover 11. The opening surface 20*a* of the suction inlet 20 is nearly horizontal and is either coplanar with the bottom surface of the cleaner housing 10 or protruding farther down therefrom.

Another opening is provided at the back of the housing 10 with a back cover 15 detachably attached thereto in order to close it. The housing 10 also contains inside a dust collecting means 14, an electric ventilating means (hereinafter referred simply as a fan) 16 and a battery 17 in this order from the front edge to the back edge. The back top part of the housing 10 forms a handle means 18 and an operating switch 19 is provided in this neighborhood. The dust collecting section 14 and the fan 16 are disposed inside the air passage which connects the suction inlet 20 and an air outlet (not shown). The motor for the fan 16 and the battery 17, on the other hand, are kept inside a partitioned space apart from the aforementioned air passage. The space for the battery 17 opens to the back of the housing 10 so that the battery 17 can be removed from the inside for replacement.

When cleaning with a vacuum cleaner of the structure described above, the user holds the handle means 18 by a hand and turns or presses the switch 19 to start the fan 16 while maintaining the housing 10 in a nearly horizontal position as shown in FIG. 1 and causing the opening surface 20*a* of the suction inlet 20 to approach the surface (or a floor) to be cleaned. In particular, since the cleaner of the present invention can be operated while it is in a nearly horizontal position, the dust accumulated inside the collection section does not fall out of the suction inlet 20 because of its positional relationship to the dust collecting means even if the operation of the fan 16 is stopped. Since the opening surface 20*a* of the suction inlet 20 is either coplanar with or protruding below the bottom surface of the housing 10, furthermore, this positional relationship allows the suction inlet 20 to come close to the surface to be cleaned while the housing 10 is maintained nearly horizontal. The opening surface 20*a* of the suction inlet 20 may be so designed as to make a small angle with the horizontal plane as long as the vertical positional relationship between the suction inlet 22 and the dust collecting means 14 is not reversed. A bumper made of a soft material such as rubber may be attached to the opening edge of the suction inlet 20 in order to protect furniture against possible scratches.

A storage section 22 for holding inside a suction accessory 21 for cleaning gaps and other small areas is formed in the back portion of the housing 10. It comprises the space at the side of the battery 17 and a door 23 thereto is provided on the back cover 15.

The suction accessory 21 is approximately L-shaped, consisting of a base part 21*a* which engages with the suction inlet 20 and a suction pipe part 21*b*. As shown in FIG. 1, it is detachably engaged to the suction inlet 20 of the housing 10. According to the first embodiment of the present invention, the suction inlet 20 is made sufficiently large for this purpose. The shape of the storage section 22 depends on the external shape of the suction accessory 21 so that the latter can be easily held inside the housing 10. The back cover 15 is removable whether the suction accessory 21 is inside or not. The advantage of having this storage section 22 inside the housing 10 is that the suction accessory 21 can be taken out immediately when a need arises. Moreover, the suction accessory 21 does not cause any trouble in cleaning when stored in the storage section 22.

Figure 4:
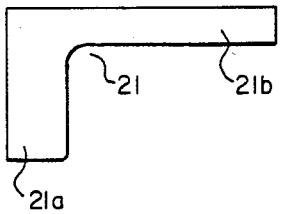
FIG. 4 shows an example of suction accessory for cleaning small gaps.
Figure 5:
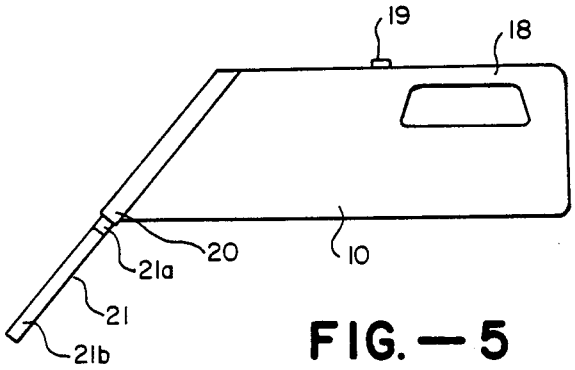
FIG. 5 is a side view of a vacuum cleaner with the suction accessory of FIG. 4 attached thereto.
Figure 6A:
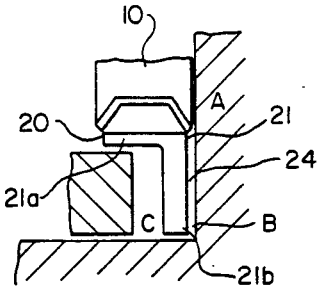
FIGS. 6(*a*) and 6(*b*) show how a vacuum cleaner is used with the suction accessory of FIG. 4 attached thereto.
Figure 6B:
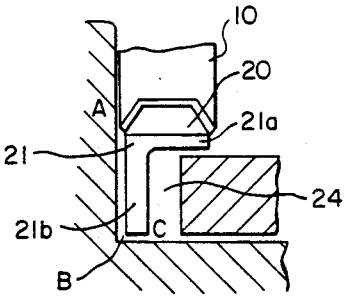

FIG. 4 shows an example of such a suction accessory 21. The flat suction pipe part 21*b* is attached on one side of the base part 21*a*. FIG. 5 is a side view when the suction accessory 21 is attached to the suction inlet 20. The base part 21*a* is designed to be engageable to the suction inlet 20 even if it is rotated to the right or to the left. FIGS. 6(*a*) and 6(*b*) show how the suction accessory 21 can be rotated in accordance with the situation when it is attached to the suction inlet 20. Even if the area to be cleaned has a gap shown in FIG. 6(*a*) or 6(*b*), the part shown by A presents no problem; not only the part shown by C in the gap but also the part shown by D can be cleaned by means of this accessory.

Figure 7:
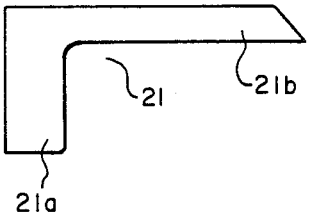
FIG. 7 is a plan view showing another example of a suction accessory.

According to the embodiment shown in FIG. 4, the end of the suction pipe part 21*b* is cut horizontally but it may be cut at an angle as shown in FIG. 7. This makes it still easier to remove dust from corners in a gap.

Figure 8:
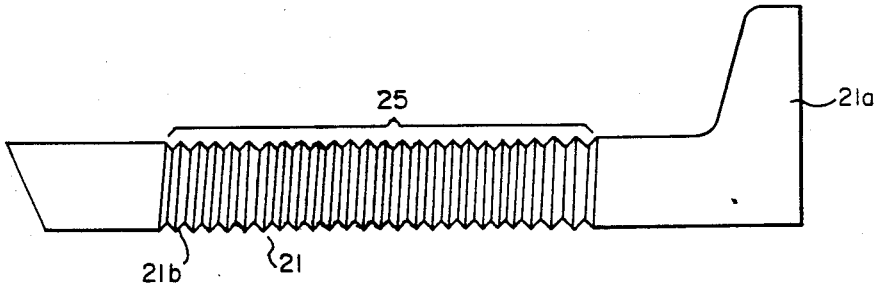
FIG. 8 is a plan view showing a third example of a suction accessory.
Figure 9A:
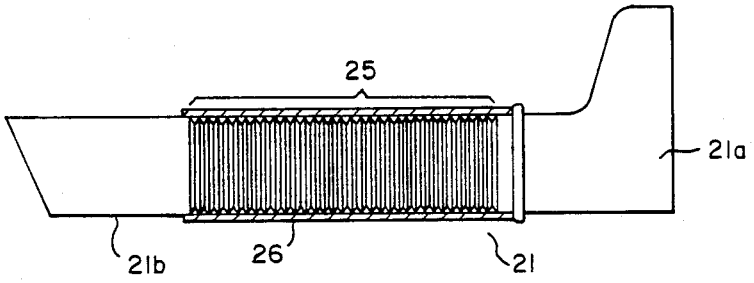
FIGS. 9(*a*) and 9(*b*) are plan views showing a fourth example of a suction accessory.
Figure 9B:
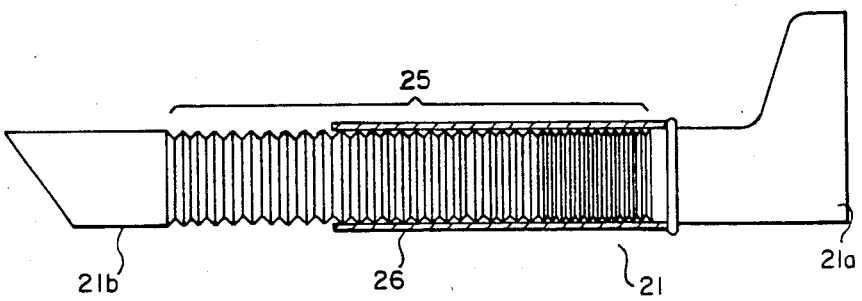
Figure 11:
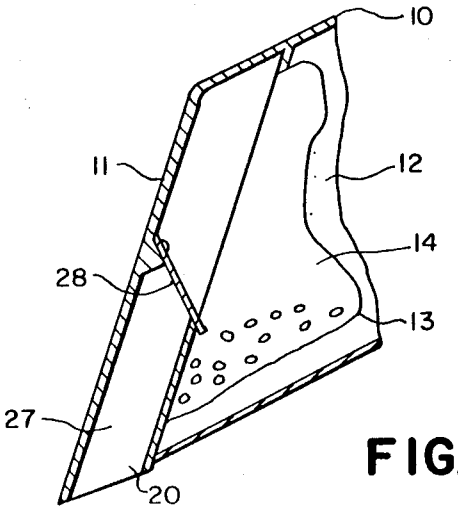
FIG. 11 shows the structure of a portion of the vacuum cleaner of FIG. 10.

In FIGS. 8 and 9, there are shown still other embodiments of the suction accessory according to the present invention, wherein a middle section 25 of the suction pipe part 21*b* of the L-shaped suction accessory 21 is made expandable in the form of a bellows so that even deeper gaps can be effectively cleaned. The middle section 25 should be compressed when the accessory 21 is stored in the storage section 22. A cylindrical piece 26 may be provided as shown in FIGS. 11(*a*) and 11(*b*) to cover the bellows portion 25 of the suction pipe part 21*b*. Such a piece can be convenient because the length of the suction pipe part 21*b* can be optionally controlled according to the situation. When the accessory 21 is stored, the suction pipe part 21*b* must again be in the most compressed condition.

Next, the structure of the front cover 11 and the methods of attaching it to the cleaner housing 10 will be described with the help of FIGS. 10 to 13 in which parts corresponding to those in FIGS. 1 to 9 will be assigned like numerals.

Figure 10:
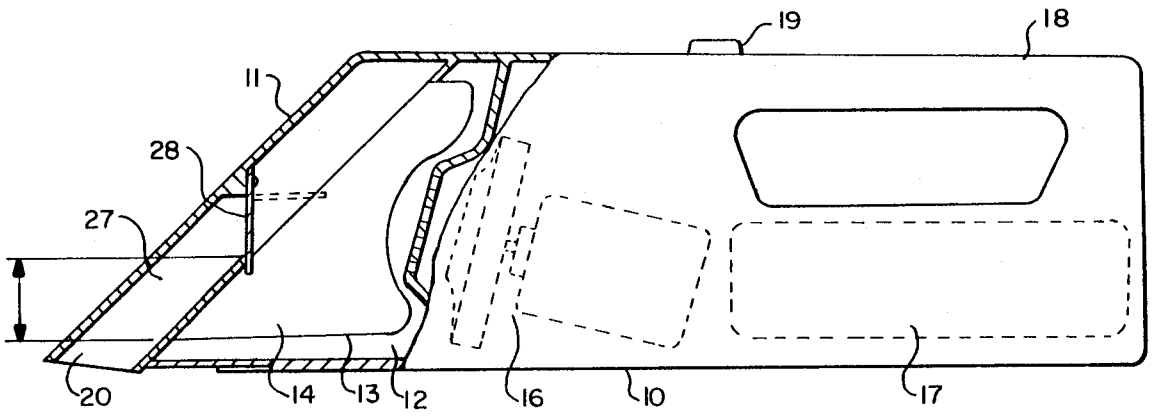
FIG. 10 is a partially sectional side view of a portable vacuum cleaner according to another embodiment of the present invention.

There is shown in FIGS. 10 and 11 an intake air passage 27 inside the front cover such that one of its ends reaches the suction inlet 20 while the other end opens into the dust collecting means 14 at a point which is above the inner bottom surface of the dust collecting means 14 by a vertical distance of H. A check valve 28 made, for example, of a rubber sheet is provided at the opening end of the passage 27 and is affixed along one edge onto the front cover 11 by means, for example, of screws.

Dust particles which were sucked in through the suction inlet 20 by an air flow caused by the fan 16 travel inside the air passage 27 to enter the dust collecting means 14 by pushing open the check valve 28 and they are caught there by the filter 13 and accumulated. If the user turns off the fan 16 by holding the means 18 and lifts the body 10 to make its back end higher, the accumulated dust in the dust collecting means 14 does not move out into the air passage 27 because the opening of the air passage 27 where the check valve 28 is provided is higher than the bottom surface by a distance of H. Even if the check valve 28 keeps opening and closing due to vibrations, for example, the dust particles inside the dust collecting means 14 do not move out into the air passage 27 and hence do not fall out of the suction inlet 20.

Figure 12:
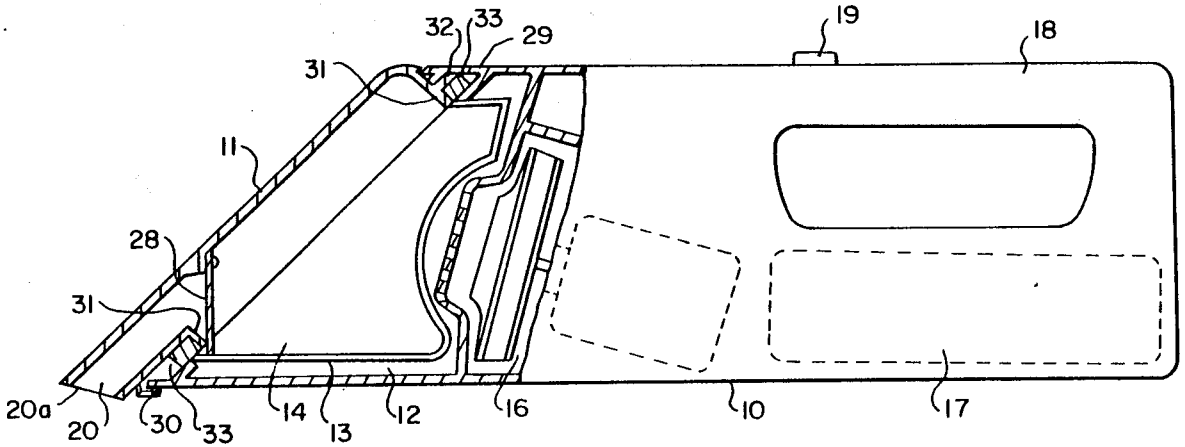
FIG. 12 is a partially sectional side view of a portable vacuum cleaner according to a third embodiment of the present invention.
Figure 13:
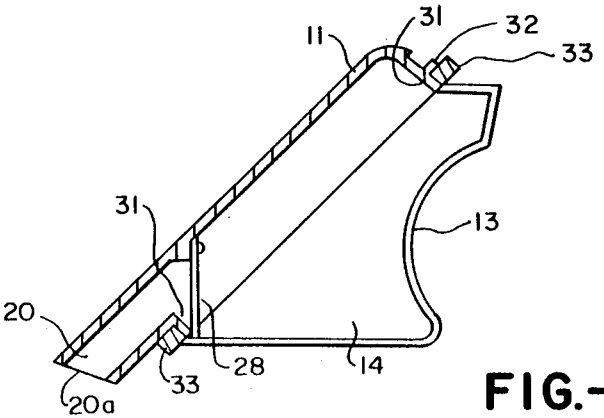
FIG. 13 shows the attachment of a bag filter to the front cover of the vacuum cleaner of FIG. 12.

In FIGS. 12 and 13, there are shown a concave engaging groove 29 which is formed above the opening part of the container section 12, a clamp 30 below the opening part of the container section 12 and a cylindrical filter attaching means 31.

The filter bag 13 is provided at its opening with a packing 33 by means of which it is removably attached to the filter attaching means 31. The front cover 11 is then attached to the front surface of the housing 10 after both the protruding piece 32 and the filter packing 33 are engagingly inserted into the groove 29. When the clamp 30 at the bottom is engaged, the front opening of the container section 12 becomes closed with the filter bag 13 contained inside. The filter packing 33 thereby maintains an airtight connection between the cleaner housing 10 and the front cover 11, preventing air leakage.

Figure 14:
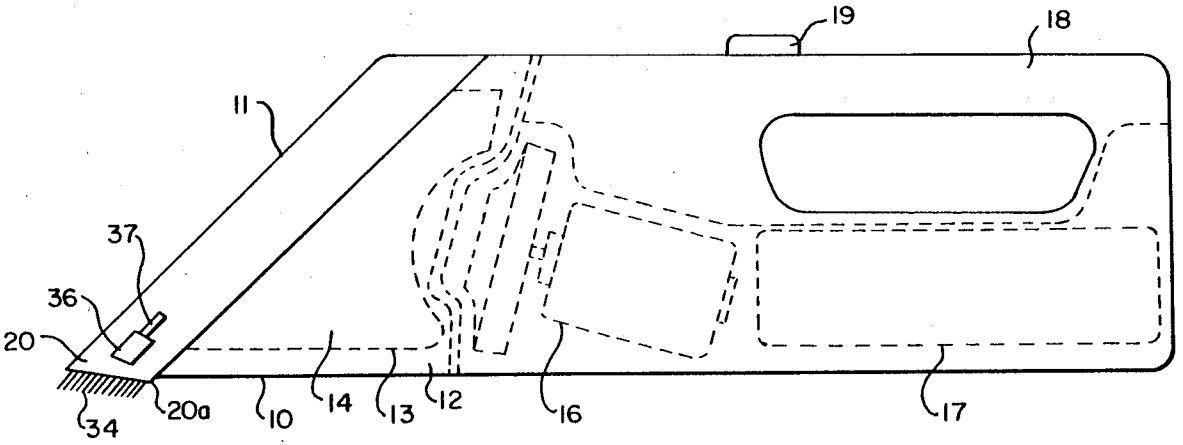
FIG. 14 is a side view of a portable vacuum cleaner according to a fourth embodiment of the present invention which holds a brush inside.
Figure 15B:
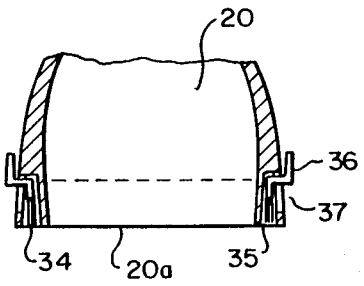
FIGS. 15(*a*) and 15(*b*) are cross-sectional views of the brush of FIG. 14.
Figure 15A:
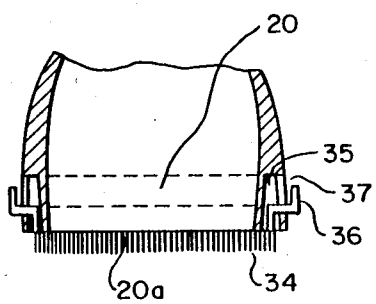

When it is desired to discard the accumulated dust, the clamp 30 is first disengaged, the front cover 11 is removed and the removed front cover 11 should then be carried with the filter bag 13 remaining attached thereto. The filter bag 13 should be taken off the front cover 11 only after the place is reached where the dust is discarded. Since there are dust particles attached to the inner surface, the bag should be shaken with its opening facing downward so that not only the accumulated dust but also the particles on the inner surface can be removed at the same time. FIGS. 14, 15(*a*) and 15(*b*) show another embodiment of the present invention wherein a brush 34 is slidably mounted at the suction inlet 20 of the front cover 11 so that the brush 34 can be made to protrude, depending on the condition of the place to be cleaned. No. 35 is a groove in which the brush 34 is contained, No. 36 is a handle for moving the brush 34 up and down, and No. 37 is a slot in which the handle 36 can move. Although no mechanism is shown, the brush 34 is adapted to maintain its protruding and stored positions respectively.

Figure 16:
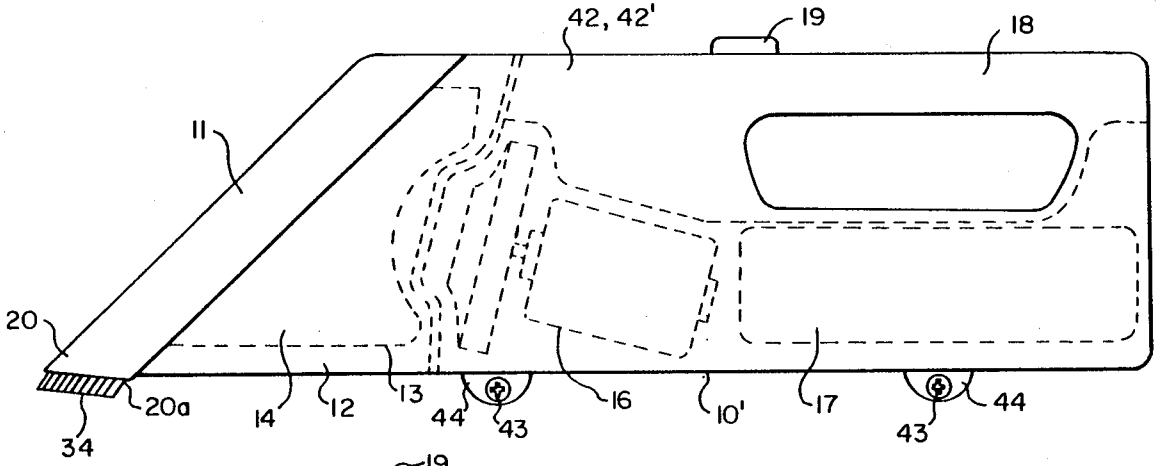
FIG. 16 is a side view of a portable vacuum cleaner according to a fifth embodiment of the present invention which includes a brush.
Figure 17:
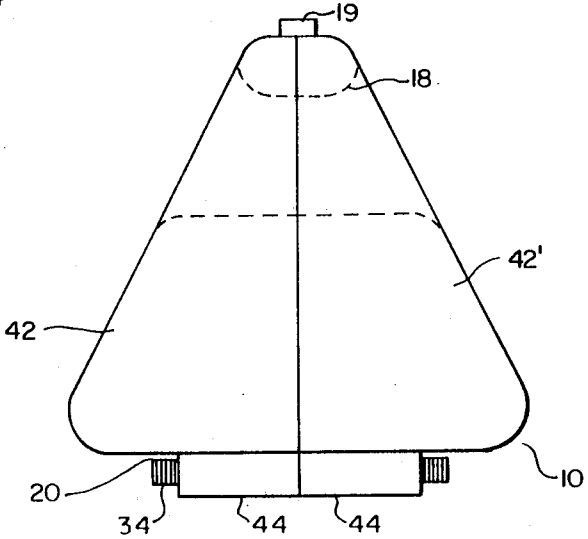
FIG. 17 is a back view of the vacuum cleaner of FIG. 16.
Figure 18:
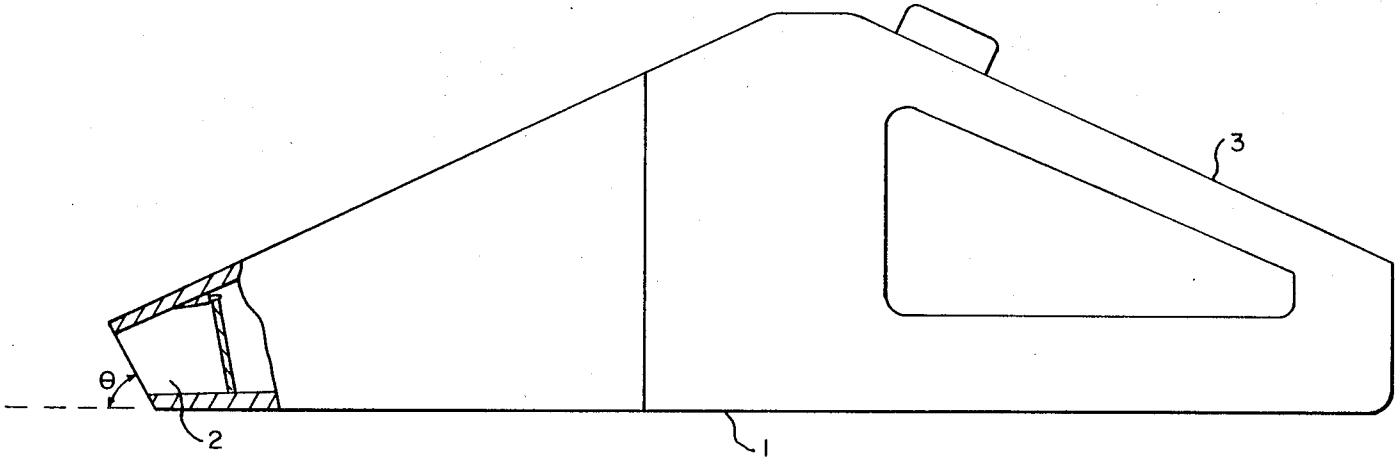
PRIOR ART FIG. — 18
FIG. 18 is a partially sectional side view of a conventional portable vacuum cleaner.
Figure 19:
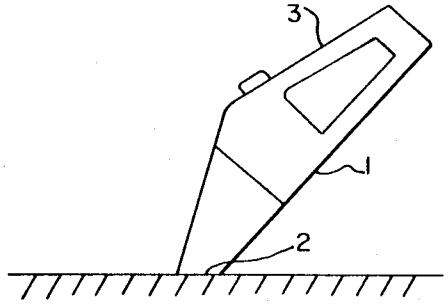
PRIOR ART FIG. — 19
FIG. 19 shows how the vacuum cleaner of FIG. 18 is used.

FIGS. 16 and 17 show a further embodiment of the present invention characterized in that the housing 10' is divided into a pair of cases 42 and 42', which may be joined, for example, by engaging them together at the top and fastening at the bottom with a screw or a bolt. FIG. 16 shows the housing 10' built with two pairs of bosses (protrusions) 44 separated longitudinally, each pair being fastened together with a bolt 43. These bosses 44 are designed to protrude farther from the bottom surface of the housing 10' than the lower surface of the brush 34 so that when the cleaner is put on the floor, there will be left a space between the brush 34 and the floor surface. This will prevent the brush from becoming crushed by the weight of the cleaner itself or otherwise deformed when the cleaner is left on a floor. Although the bosses 44 are used in this embodiment both for connecting the cases 42 and 42' together and for separating the lower surface of the brush 34 from the floor surface, protrusions for keeping the bottom surface of the brush off the floor and those for fastening the cases 42 and 42' together may be separately formed.

The brush 34 is disposed entirely around the circumference of the suction inlet 20 and protrudes downward from the opening surface 20*a* thereof. It may be made retractable as shown in FIGS. 14 and 15 or detachable. The fan 16 need not depend entirely on the battery 17 for power. It may be made operable with a house current.

In summary, a vacuum cleaner according to the present invention can operate effectively while it is maintained in a nearly horizontal position. It is because the accumulated dust will not fall out of the suction inlet when the motor is switched off and the filter bag can be emptied easily. Since accessories such as an attachment for cleaning narrow gaps can be stored inside the cleaner housing, the user need not worry about separate storage of such an attachment or finding it when a need therefor arises.

This invention has been described above in terms of a limited number of embodiments but the description given above is not intended to limit the scope of the invention. Many variations that can be made by a person skilled in the art are considered to be within the purview of the invention. The scope of this invention therefore is limited only by the following claims.

What is claimed is:

1. A portable vacuum cleaner comprising a housing having a front end, back end and a bottom surface, said front end being formed with a suction inlet having an opening, the surface defining said opening being no higher than said bottom surface, a dust collecting means inside said housing, a suction-generating means behind said dust collecting means inside said housing, and a brush which is slidably mounted to said suction inlet, said bottom surface including protrusions such that, when said cleaner is placed on a flat surface, said brush will be kept above said flat surface, said housing being separable into two mutually connectable sections, said sections comprising at least one pair of bosses, each said pair of bosses being adapted to be fastened to each other by a screw means, said at least one pair of bosses being adapted to form at least one of said protrusions when fastened together.

2. A portable vacuum cleaner comprising a housing having a front end, a back end and a bottom surface, said front end being formed with a suction inlet having an opening, the surface defining said opening being no higher than said bottom surface, said suction inlet comprising a brush which protrudes below said below surface of said housing, a dust collecting means inside said housing, and a suction-generating means behind said dust collecting means inside said housing, said bottom surface including protrusions such that, when said cleaner is placed on a flat surface, said brush will be kept above said flat surface, said housing being separable into two mutually connectable sections, said sections comprising at least one pair of bosses, each said pair of bosses being adapted to be fastened to each other by a screw means, said at least one pair of bosses being adapted to form at least one of said protrusions when fastened together.

3. A portable vacuum cleaner comprising a housing with a dust collecting section unistructurally formed therewith, said dust collecting section having an open front surface, a front cover which is detachably attachable to said housing to thereby cover said open front surface of said dust collecting section, and a filter bag which is disposed inside said dust collecting section, said housing having a groove formed thereon near said open front surface, said front cover having formed thereon a clamping means which is engageable with said groove on said housing as said front cover is attached to said housing to thereby clamp a part of said filter bag between said front cover and said housing.

4. The vacuum cleaner of claim 3 wherein said front cover includes an inlet for collecting dust particles therethrough and an oulet for delivering collected dust particles into said dust collecting section.

* * * * *